US008393340B2

(12) United States Patent
Tung

(10) Patent No.: US 8,393,340 B2
(45) Date of Patent: Mar. 12, 2013

(54) FLEXIBLE SUNSHADE

(76) Inventor: Benson Tung, Kaohsiung (TW)

( * ) Notice: Subject to any disclaimer, the term of this patent is extended or adjusted under 35 U.S.C. 154(b) by 0 days.

(21) Appl. No.: 13/186,543

(22) Filed: Jul. 20, 2011

(65) Prior Publication Data

US 2013/0019914 A1 Jan. 24, 2013

(51) Int. Cl.

| | |
|---|---|
| ***A45B 25/02*** | (2006.01) |
| ***A45B 25/06*** | (2006.01) |
| ***A45B 17/00*** | (2006.01) |
| ***A45B 25/22*** | (2006.01) |

(52) U.S. Cl. ..... 135/15.1; 135/20.1; 135/28

(58) Field of Classification Search ..... 135/15.1, 135/20.1, 28

See application file for complete search history.

(56) References Cited

U.S. PATENT DOCUMENTS

| | | | | |
|---|---|---|---|---|
| 588,958 | A * | 8/1897 | Crandall | 135/20.1 |
| 5,297,570 | A * | 3/1994 | Conner | 135/16 |
| 6,328,047 | B1 * | 12/2001 | Lee | 135/20.1 |
| 6,848,459 | B2 * | 2/2005 | Ma | 135/20.1 |
| 7,537,016 | B1 * | 5/2009 | You | 135/16 |
| 2009/0188537 | A1 * | 7/2009 | Bacik | 135/16 |

* cited by examiner

*Primary Examiner* — David Dunn
*Assistant Examiner* — Danielle Jackson
(74) *Attorney, Agent, or Firm* — Alan Kamrath; Kamrath IP Lawfirm, P.A.

(57) ABSTRACT

A flexible sunshade includes an elastic element having a lower end mounted to an upper end of a pole. A hub is fixed to an upper end of the elastic element. A canopy is mounted to a plurality of ribs each having an end pivotably connected to the hub. A runner is slideably mounted to the pole. A first end of each of a plurality of stretchers is pivotably connected to the runner. A second end of each stretcher is pivotably connected to one of the ribs. When the canopy, the ribs, or the hub is subjected to a force at a non-parallel angle to a longitudinal axis of the pole, the elastic element flexes to cause the hub to flex in a direction of the force, absorbing at least a portion of the force acting on the flexible sunshade.

1 Claim, 5 Drawing Sheets

FLEXIBLE SUNSHADE

BACKGROUND OF THE INVENTION

The present invention relates to a sunshade and, more particularly, to a large sunshade that is generally used outdoors and that can flex to reduce damage possibility of the components of the sunshade.

A type of outdoor sunshade includes a pole having a bottom end located on the ground and a plurality of ribs each having an end pivotably connected to a top end of the pole. A runner is slideably mounted to the pole. A plurality of stretchers is pivotably connected between the runner and the ribs, allowing the sunshade to move between a folded state and an unfolded state. A canopy is provided on the ribs. When the sunshade is subjected to wind, the components of the sunshade are liable to be damaged, because the canopy has a large area. The sunshade may even fall to the ground if the wind is strong, causing damage to the components, particularly at the pivotal connections of the components.

In an approach to avoid damage to the components, the pole includes spaced upper and lower pole sections. The ribs are pivotably connected to the upper pole section. The runner is slideably mounted to the upper pole section. An elastic element in the form of a coil spring or the like is mounted below the runner and includes two ends respectively coupled to a lower end of the upper pole and an upper end of the lower pole. When the sunshade is subjected to strong wind, the upper pole section, the ribs, and the stretchers flex to reduce the damage possibility. Even if the sunshade falls to the ground, the elastic element flexes and deforms while the sunshade impacts the ground, absorbing the impact to reduce the damage possibility. However, since the elastic element is mounted below the runner, the head of the user under the sunshade may be hit by the distal ends of some of the ribs that move towards the ground when the sunshade bends under a wind load.

Thus, a need exists for a novel flexible sunshade avoiding injury to the user while reducing damage possibility of the components when the sunshade falls to the ground under a wind load.

BRIEF SUMMARY OF THE INVENTION

The present invention solves this need and other problems in the field of safe use of sunshades by providing a flexible sunshade including a pole having upper and lower ends spaced along a longitudinal axis of the pole. An elastic element includes upper and lower ends spaced along the longitudinal axis. The lower end of the elastic element is mounted to the upper end of the pole. A hub is fixed to the upper end of the elastic element. An end of each of a plurality of ribs is pivotably connected to the hub. A canopy is mounted to the plurality of ribs. A runner is mounted to the pole and located between the lower end of the elastic element and the lower end of the pole. The runner is slideable along the longitudinal axis between an upper position and a lower position. The runner in the lower position has a spacing to the lower end of the elastic element larger than in the upper position. A first end of each of a plurality of stretchers is pivotably connected to the runner. A second end of each of the plurality of stretchers is pivotably connected to one of the plurality of ribs. The canopy collapses when the runner is in the lower position. The canopy is extended by the plurality of stretchers when the runner is in the upper position.

When the canopy, the plurality of ribs, or the hub is not subjected to a force at a non-parallel angle to the longitudinal axis, the upper end of the elastic element substantially extends coaxially to the longitudinal axis.

On the other hand, when the canopy, the plurality of ribs, or the hub is subjected to a force at a non-parallel angle to the longitudinal axis, the elastic element flexes to cause the hub to flex in a direction of the force, absorbing at least a portion of the force acting on the flexible sunshade.

In a form, the flexible sunshade includes two upper fixing members and two lower fixing members. The elastic element is a coil spring having a plurality of coils. Each upper fixing member extends in a radial direction perpendicular to the longitudinal axis and extends through the hub and into a gap of two adjacent coils of the upper end of the coil spring to fix the hub to the upper end of the coil spring. The upper fixing members are aligned with each other. Each lower fixing member extends in a radial direction perpendicular to the longitudinal axis and extends through the upper end of the pole and a gap of two adjacent coils of the lower end of the coil spring to fix the lower end of the coil spring to the upper end of the pole. The lower fixing members are aligned with each other.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
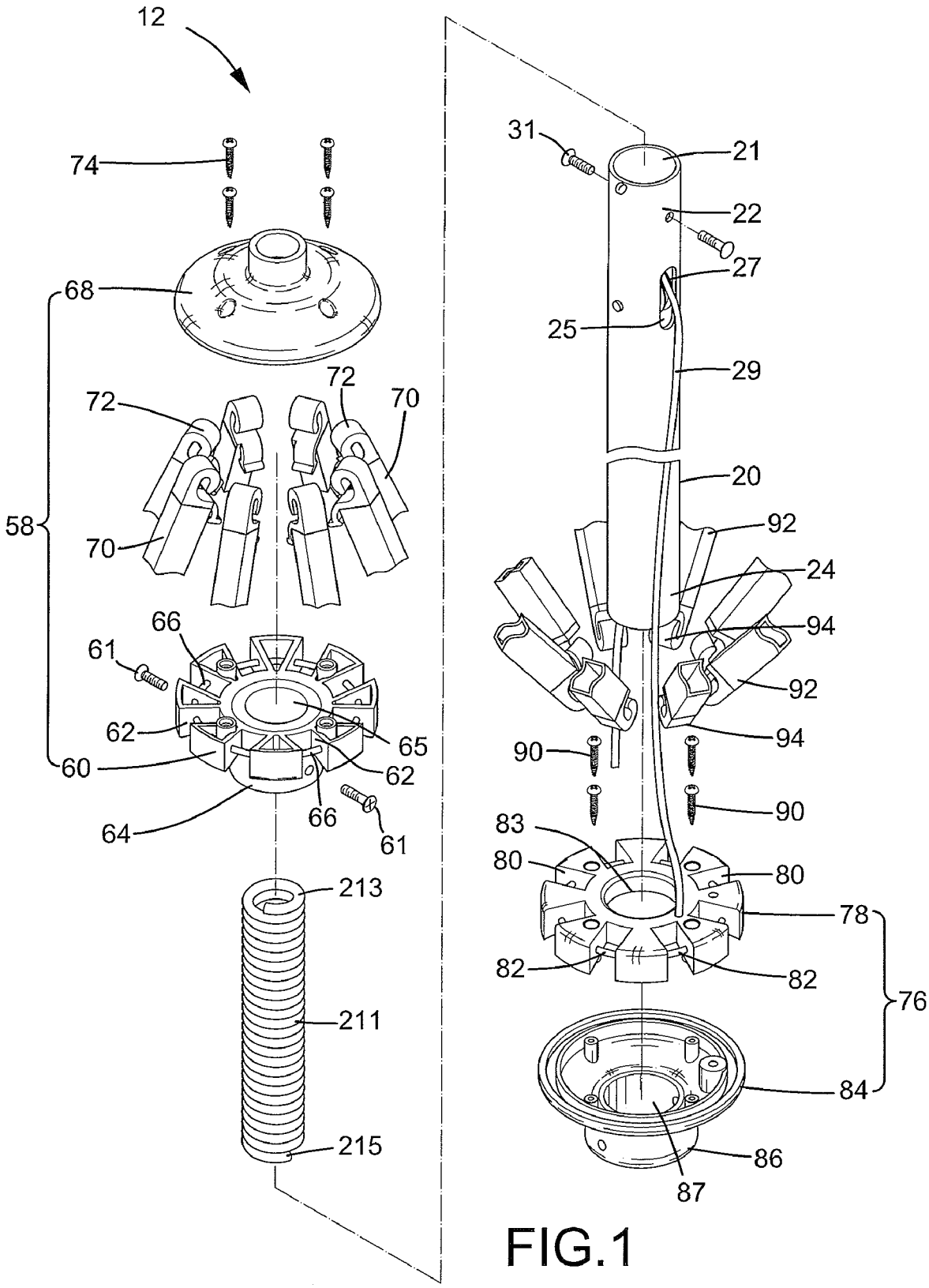
FIG. 1 shows a partial, exploded, perspective view of a flexible sunshade according to the present invention.
Figure 2:
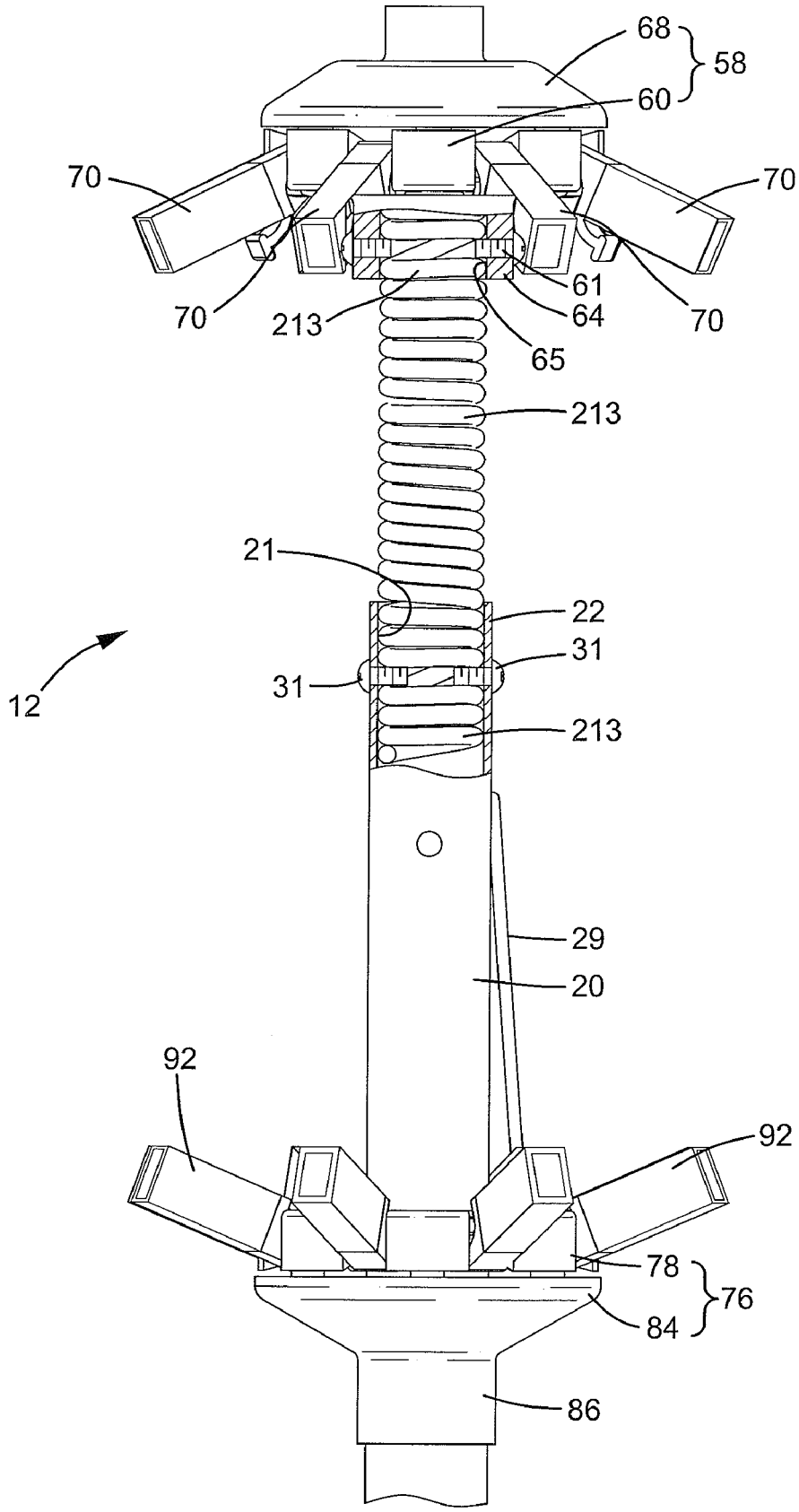
FIG. 2 shows a partial, side view of the flexible sunshade of FIG. 1, with portions broken away.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "outer", "top", "end", "portion", "longitudinal", "radial", "annular", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A flexible sunshade according to the present invention is shown in the drawings and generally designated 12. Flexible sunshade 12 is generally used outdoors and located on a surface such as the ground. According to the form shown, flexible sunshade 12 includes a pole 20 having upper and lower ends 22 and 24 spaced along a longitudinal axis of pole 20. Lower end 24 of pole 20 can be mounted on a base 33 to assist in maintaining pole 20 in an upright position on the ground. Pole 20 further includes a longitudinal hole 21 extending from upper end 22 through lower end 24 along the longitudinal axis. A slot 25 is defined in an outer periphery of pole 20 extending between upper and lower ends 22 and 24 and is in communication with longitudinal hole 21. A roller 27 is rotatably received in longitudinal hole 21 and aligned with slot 25. A winding device 217 is mounted on pole 20 between upper and lower ends 22 and 24. Winding device 217 includes a handle 219 having a shaft. A cable 29 is wound around roller 27 and has an end attached to the shaft of handle 219.

According to the form shown, flexible sunshade 12 further includes an elastic element 211 in the form of a coil spring having a plurality of coils. Elastic element 211 includes upper and lower ends 213 and 215 spaced along the longitudinal axis. Elastic element 211 has a diameter slightly smaller than that of longitudinal hole 21 of pole 20. Lower end 215 of elastic element 211 is engaged in longitudinal hole 21 at upper end 22 of pole 20. Upper end 213 of elastic element 211 is located above upper end 22 of pole 20. Lower end 215 of elastic element 211 is fixed to upper end 22 of pole 20 by two lower fixing members 31 in the form shown as two screws each extending in a radial direction perpendicular to the longitudinal axis and extending through upper end 22 of pole 20 and into a gap between two adjacent coils of lower end 215 of elastic element 211. Lower fixing members 31 are aligned with each other. Thus, elastic element 211 can not be disengaged from pole 20 by moving along the longitudinal axis.

Figure 3:
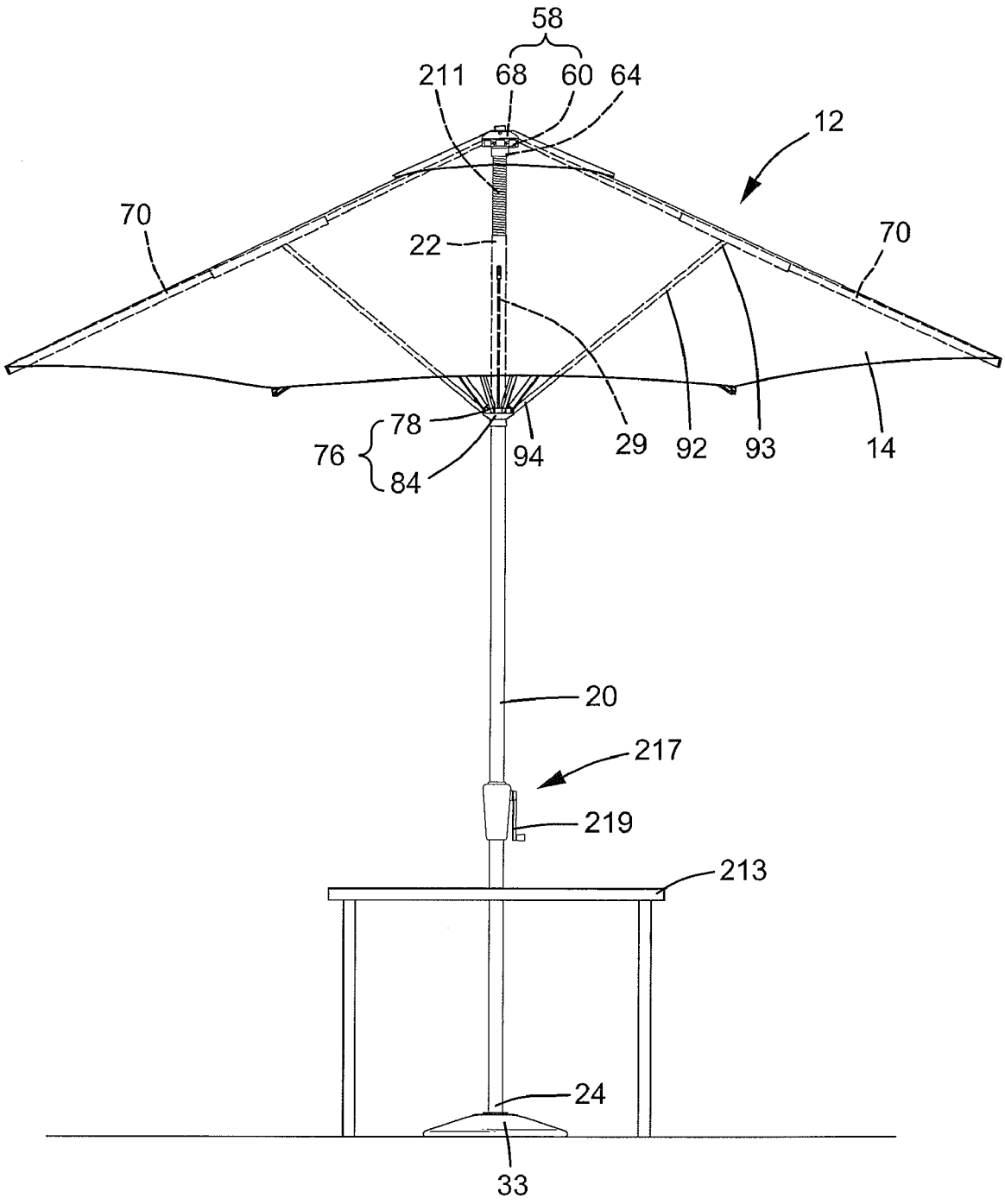
FIG. 3 shows a side view of the flexible sunshade of FIG. 1, with the flexible sunshade located in a center of a table.

According to the form shown, flexible sunshade 12 further includes a hub assembly 58 including a hub 60 fixed to upper end 213 of elastic element 211. Hub 60 includes a plurality of annularly spaced pivotal grooves 62 each receiving a pin 66. Hub 60 includes a neck 64 at a lower portion thereof. Neck 64 has a hole 65 receiving upper end 213 of elastic element 211. Two upper fixing members 61 in the form shown as two screws are extended through neck 64 in a radial direction perpendicular to the longitudinal axis into a gap between two adjacent coils of upper end 213 of elastic element 211. Thus, hub 60 is fixed on upper end 213 of elastic element 211. When elastic element 211 is not subjected to force and does not deform, elastic element 211 and hub 60 substantially extend coaxially to the longitudinal axis. When elastic element 211 is subjected to a force at a non-parallel angle to the longitudinal axis of pole 20, upper end 213 of elastic element 211 flexes in the direction of the force. A plurality of ribs 70 is provided and each includes a hooked end 72 received in one of pivotal grooves 62 and pivotably connected to one of pins 66. A canopy 14 is mounted to ribs 70. Ribs 70 and canopy 14 move jointly with hub 60 when elastic element 211 flexes. Hub assembly 58 further includes an upper cap 68 fixed by screws 74 to hub 60 for closing upper ends of pivotal grooves 62 and preventing ribs 70 from disengaging from pins 66. Ribs 70 can pivot between an unfolded position (FIG. 3) and a folded position.

According to the form shown, flexible sunshade 12 further includes a runner assembly 76 mounted to pole 20. Runner assembly 76 includes a runner 78 having a plurality of annularly spaced pivotal grooves 80 each receiving a pin 82. The other end of cable 29 is attached to runner 78. Runner 78 includes a through-hole 83 slideably receiving pole 20. Thus, the runner 78 is slideable along the longitudinal axis between an upper position and a lower position. Runner 78 is located between lower end 215 of elastic element 211 and lower end 24 of pole 20. Runner 78 in the lower position has a spacing to lower end 215 of elastic element 211 larger than in the upper position.

According to the form shown, flexible sunshade 12 further includes a plurality of stretchers 92 each having a first end 94 received in one of pivotal grooves 80 and pivotably engaged with one of pins 82. Each stretcher 92 further includes a second end 93 pivotably connected to an intermediate portion of one of ribs 70.

According to the form shown, runner assembly 76 further includes a lower cap 84 having a skirt 86. Lower cap 84 is fixed by fasteners 90 to runner 78 to close lower ends of pivotal grooves 80 by skirt 86 and preventing first ends 94 of stretchers 92 from disengaging from pins 82. Skirt 86 includes a through-hole 87 slideably receiving pole 20. Canopy 14 collapses when runner 78 is in the lower position. On the other hand, canopy 14 is extended by the stretchers 92 when runner 78 is in the upper position. Specifically, runner 78 moves to the lower position when handle 219 is rotated to release cable 29. Stretchers 92 and ribs 70 move towards pole 20 to collapse canopy 14. On the other hand, runner 78 moves to the upper position when handle 219 is rotated to wind cable 29 around the shaft of handle 219. Stretchers 92 and ribs 70 move away from pole 20 to extend canopy 14.

Now that the basic construction of flexible sunshade 12 of the present invention has been explained, the operation and some of the advantages of flexible sunshade 12 can be set forth and appreciated. In particular, for the sake of explanation, it will be assumed that flexible sunshade 12 is located in a center of a table 231 and is in an unfolded state in which canopy 14 is extended. When canopy 14, ribs 70, or hub 60 is not subjected to a force at a non-parallel angle to the longitudinal axis, upper end 213 of elastic element 211 substantially extends coaxially to the longitudinal axis. Canopy 14 remains in the extended state. On the other hand, when canopy 14, ribs 70, or hub 60 is subjected to a force at a non-parallel angle to the longitudinal axis, elastic element 211 flexes to cause hub 60 to flex relative to the longitudinal axis of pole 20. Thus, hub 60 can flex in the direction of the force to absorb the force acting on flexible sunshade 12.

Figure 5:
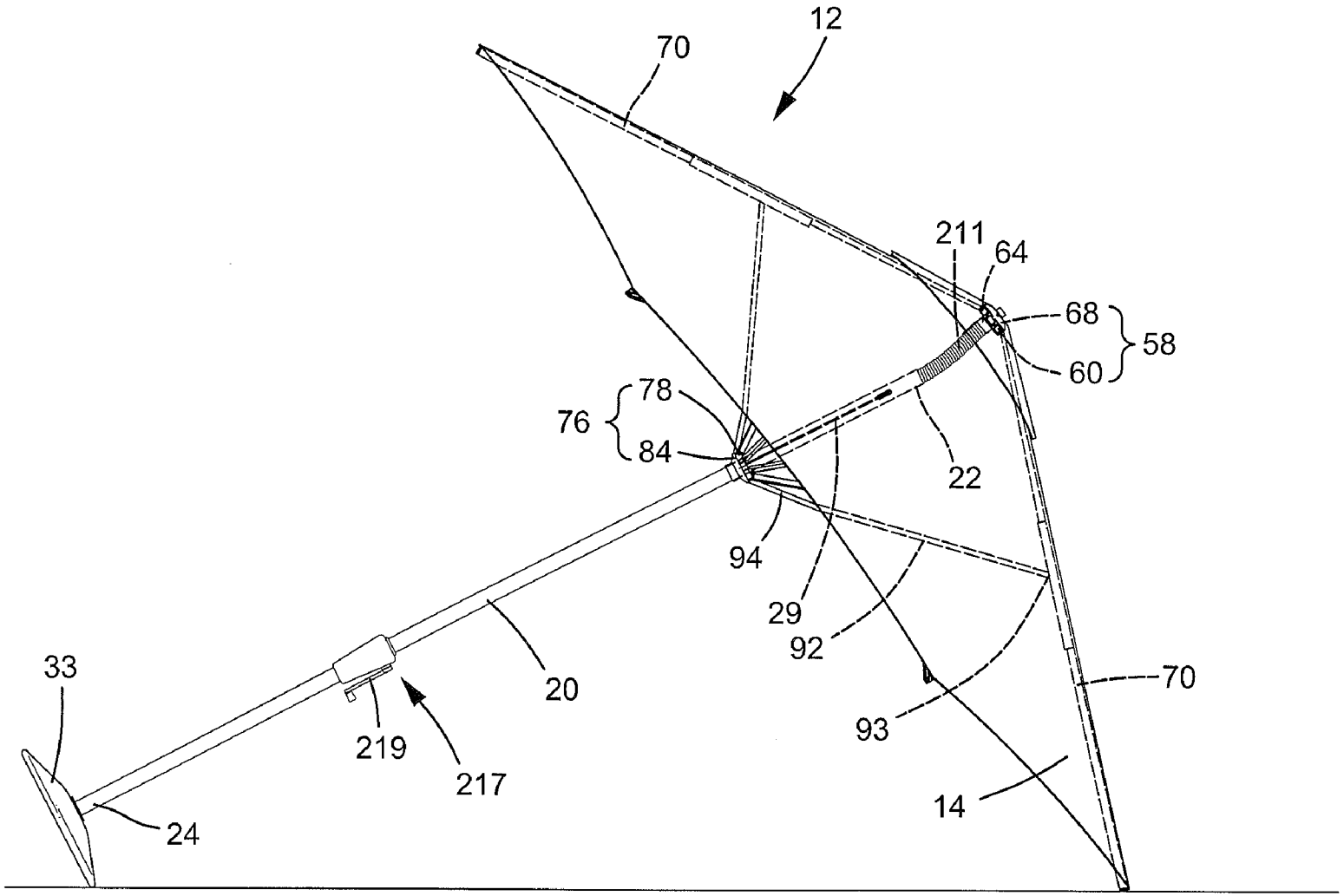
FIG. 5 shows a view of the flexible sunshade of FIG. 1, with the flexible sunshade fallen to the ground.

In a case that flexible sunshade 12 is not located in table 231, flexible sunshade 12 may fall to the ground if subjected to a strong wind, as shown in FIG. 5. The impact force at the distal ends of some of ribs 70 impacting the ground is transmitted to elastic element 211. Thus, elastic element 211 flexes in the direction of the impact force to absorb at least a portion of the impact force, reducing damage possibility of the components of flexible sunshade 12.

Figure 4:
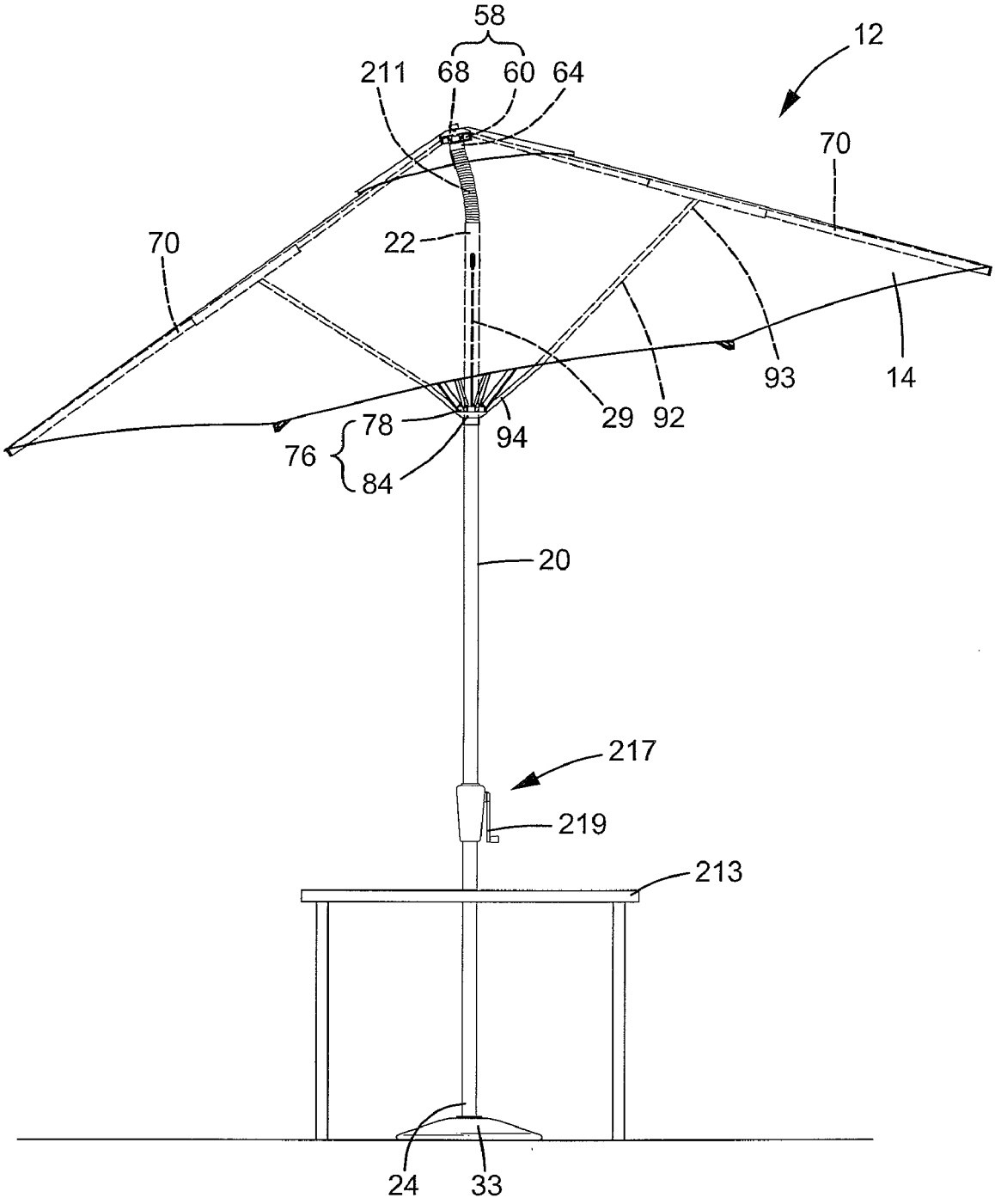
FIG. 4 shows a view similar to FIG. 3, with the flexible sunshade flexed under a wind load.

Since elastic element 211 is mounted on top of upper end 22 of pole 20, when elastic element 211 flexes in the direction of the force and, thus, causes ribs 70 to tilt, the spacing between the distal end of each rib 70 and the ground is still relatively large. Specifically, since each rib 70 pivotably mounted to hub 60 is connected to a stretcher 92, the spacing between hub 60 and each rib 70 is limited by the tolerance between the components of flexible sunshade 12 and the flexibility of the components. Thus, each rib 70 can have a tilt angle not larger than 20° (10° in FIG. 4). As a result, a user under flexible sunshade 12 is less likely to be injured by the distal ends of ribs 70 even though flexible sunshade 12 bends under a wind load.

Now that the basic teachings of the present invention have been explained, many extensions and variations will be obvious to one having ordinary skill in the art. For example, instead of a coil spring, elastic element 211 can be in the form of a hollow, elastic rubber tube. In this case, upper and lower fixing members 61 and 31 extend into upper and lower ends 213 and 215 of the elastic rubber tube.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A flexible sunshade comprising, in combination:

a pole including upper and lower ends spaced along a longitudinal axis of the pole;

a coil spring including upper and lower ends spaced along the longitudinal axis, with each of the upper and lower ends of the coil spring having a plurality of coils, with the lower end of the coil spring mounted to the upper end of the pole;

a hub fixed to the upper end of the coil spring;

two upper fixing members, with each of the two upper fixing members extending in a radial direction perpendicular to the longitudinal axis and extending through the hub and into a gap of two adjacent coils of the upper end of the coil spring to fix the hub to the upper end of the coil spring, with the two upper fixing members aligned with each other;

two lower fixing members, with each of the two lower fixing members extending in a radial direction perpendicular to the longitudinal axis and extending through the upper end of the pole and a gap of two adjacent coils of the lower end of the coil spring to fix the lower end of the coil spring to the upper end of the pole, with the two lower fixing members aligned with each other;

a plurality of ribs each having an end pivotably connected to the hub;

a canopy mounted to the plurality of ribs;

a runner mounted to the pole and located between the lower end of the coil spring and the lower end of the pole, with the runner slideable along the longitudinal axis between an upper position and a lower position, with the runner in the lower position having a spacing to the lower end of the coil spring larger than in the upper position;

a plurality of stretchers each including a first end pivotably connected to the runner and a second end pivotably connected to one of the plurality of ribs, with the canopy being collapsed when the runner is in the lower position, with the canopy extended by the plurality of stretchers when the runner is in the upper position, wherein when the canopy, the plurality of ribs, or the hub is not subjected to a force at a non-parallel angle to the longitudinal axis, the upper end of the coil spring substantially extends coaxially to the longitudinal axis, and wherein when the canopy, the plurality of ribs, or the hub is subjected to a force at a non-parallel angle to the longitudinal axis, the coil spring flexes to cause the hub to flex in a direction of the force, absorbing at least a portion of the force acting on the flexible sunshade.

* * * * *